US010717059B2

(12) United States Patent
Scaff et al.

(10) Patent No.: US 10,717,059 B2
(45) Date of Patent: Jul. 21, 2020

(54) CALCINED GYPSUM SLURRY MIXING APPARATUS HAVING VARIABLY POSITIONABLE LUMP RING AND METHOD FOR MANUFACTURING GYPSUM PRODUCT USING SAME

(71) Applicant: United States Gypsum Company, Chicago, IL (US)

(72) Inventors: Joseph Scaff, Callahan, FL (US); Lester Bell, Hilliard, FL (US)

(73) Assignee: United States Gypsum Company, Chicago, IL (US)

( * ) Notice: Subject to any disclaimer, the term of this patent is extended or adjusted under 35 U.S.C. 154(b) by 142 days.

(21) Appl. No.: 15/599,266

(22) Filed: May 18, 2017

(65) Prior Publication Data

US 2018/0333691 A1 Nov. 22, 2018

(51) Int. Cl.
*B01F 7/00* (2006.01)
*B01F 15/04* (2006.01)
(Continued)

(52) U.S. Cl.
CPC ..... *B01F 7/00841* (2013.01); *B01F 7/00758* (2013.01); *B01F 7/00791* (2013.01);
(Continued)

(58) Field of Classification Search
CPC ..... B01F 7/00841
(Continued)

(56) References Cited

U.S. PATENT DOCUMENTS 215,169 A * 5/1879 Scivalley ..... B01F 7/161 366/286
580,266 A * 4/1897 Franklin ..... B01F 3/1221 366/164.1
(Continued)

FOREIGN PATENT DOCUMENTS

CN 201763388 U 3/2011
CN 205167191 U 4/2016
(Continued)

OTHER PUBLICATIONS

European Patent Office, International Search Report and the Written Opinion in International Application No. PCT/US2018/033066 (dated Jul. 26, 2018).

*Primary Examiner* — David L Sorkin
(74) *Attorney, Agent, or Firm* — Leydig, Voit & Mayer, Ltd.; Philip T. Petti; Pradip K. Sahu

(57) ABSTRACT

A mixing apparatus for producing aqueous calcined gypsum slurry includes a housing, a rotor assembly, and an actuator system. The housing defines a mixing chamber therewithin. A top lid of the housing includes a lid ring extending along a normal axis toward a bottom thereof. The rotor assembly includes a rotor disposed within the mixing chamber and a drive shaft extending along and rotatable about the normal axis. The rotor is rotatively coupled with the drive shaft and extends radially therefrom. The upper surface of the rotor and the lid ring are separated by a lid ring gap along the normal axis. The actuator system is arranged with the rotor assembly to selectively move the rotor over a range of travel along the normal axis between a lowered position and a raised position to selectively change the lid ring gap.

20 Claims, 5 Drawing Sheets

(51) Int. Cl.

| | |
|---|---|
| ***B01F 15/02*** | (2006.01) |
| ***B28C 7/12*** | (2006.01) |
| ***B28C 5/08*** | (2006.01) |
| ***B01F 15/00*** | (2006.01) |
| ***B28C 5/12*** | (2006.01) |
| *B01F 3/12* | (2006.01) |

(52) U.S. Cl.
CPC .... *B01F 15/00032* (2013.01); *B01F 15/0219* (2013.01); *B01F 15/0267* (2013.01); *B01F 15/0433* (2013.01); *B28C 5/0881* (2013.01); *B28C 5/1238* (2013.01); *B28C 7/126* (2013.01); *B01F 7/0075* (2013.01); *B01F 15/00149* (2013.01); *B01F 15/0272* (2013.01); *B01F 15/04* (2013.01); *B01F 2003/1257* (2013.01)

(58) Field of Classification Search
USPC ..... 366/286, 304
See application file for complete search history.

(56) References Cited

U.S. PATENT DOCUMENTS

| | | | | |
|---|---|---|---|---|
| 1,632,975 | A * | 6/1927 | Kempter | B01F 7/00925 366/97 |
| 2,601,018 | A | 6/1952 | Heyl et al. | |
| 2,712,926 | A * | 7/1955 | Von Elm | 366/250 |
| 2,716,926 | A | 9/1955 | Armstrong | |
| 2,868,516 | A | 1/1959 | Moseley | |
| 2,969,960 | A | 1/1961 | Gurley, Jr. | |
| 2,985,219 | A | 5/1961 | Summerfield | |
| 3,359,146 | A | 12/1967 | Lane et al. | |
| 4,205,919 | A | 6/1980 | Attwell | |
| 4,279,673 | A | 7/1981 | White et al. | |
| 5,320,677 | A | 6/1994 | Baig | |
| 5,439,289 | A * | 8/1995 | Neilson | A23G 9/045 366/206 |
| 5,643,510 | A | 7/1997 | Sucech | |
| 5,683,635 | A | 11/1997 | Sucech et al. | |
| 5,837,168 | A | 11/1998 | Rowe | |
| 6,059,444 | A | 5/2000 | Johnson et al. | |
| 6,086,052 | A | 7/2000 | Rowe | |
| 6,207,055 | B1 | 3/2001 | Satterfield et al. | |
| 6,347,883 | B1 | 2/2002 | Ekholm | |
| 6,494,609 | B1 | 12/2002 | Wittbold et al. | |
| 6,874,930 | B2 | 4/2005 | Wittbold et al. | |
| 7,007,914 | B2 | 3/2006 | Petersen et al. | |
| 7,296,919 | B2 | 11/2007 | Petersen et al. | |
| 7,404,917 | B2 | 7/2008 | Gannaway et al. | |
| 7,654,807 | B2 | 2/2010 | Gannaway et al. | |
| 2008/0223258 | A1 | 9/2008 | Bruce et al. | |
| 2012/0168527 | A1 | 7/2012 | Li et al. | |
| 2012/0170403 | A1 | 7/2012 | Li et al. | |
| 2013/0098268 | A1 | 4/2013 | Li et al. | |
| 2013/0099027 | A1 | 4/2013 | Li et al. | |
| 2013/0099418 | A1 | 4/2013 | Li et al. | |
| 2013/0100759 | A1 | 4/2013 | Wittbold et al. | |
| 2013/0216717 | A1 | 8/2013 | Rago et al. | |
| 2013/0233880 | A1 | 9/2013 | Rago et al. | |
| 2013/0308411 | A1 | 11/2013 | Wittbold et al. | |
| 2015/0157993 | A1 | 6/2015 | Gupta et al. | |
| 2015/0328607 | A1 | 11/2015 | Wittbold et al. | |
| 2016/0121287 | A1 | 5/2016 | Brown et al. | |
| 2017/0065950 | A1 | 3/2017 | Schenck et al. | |

FOREIGN PATENT DOCUMENTS

| | | | |
|---|---|---|---|
| CN | 205235891 | U | 5/2016 |
| DE | 3803418 | A1 | 8/1989 |
| ES | 2149086 | A1 | 10/2000 |
| GB | 665981 | A | 2/1952 |
| GB | 1518715 | A | 7/1978 |
| JP | H06-31151 | A | 2/1994 |
| KR | 200395148 | Y | 7/2005 |

* cited by examiner

CALCINED GYPSUM SLURRY MIXING APPARATUS HAVING VARIABLY POSITIONABLE LUMP RING AND METHOD FOR MANUFACTURING GYPSUM PRODUCT USING SAME

BACKGROUND

The present disclosure relates to manufacturing processes and systems for producing gypsum products from starting materials including calcined gypsum and water, and more particularly relates to a mixing apparatus for producing aqueous calcined gypsum slurry used in supplying gypsum slurry to a production line, for example a gypsum wallboard production line.

In many types of gypsum products, set gypsum (calcium sulfate dihydrate) is often a major constituent. For example, set gypsum is a major component of end products created by use of traditional plasters (e.g., plaster-surfaced internal building walls), and also in gypsum board employed in typical drywall construction of interior walls and ceilings of buildings. In addition, set gypsum is the major component of gypsum/cellulose fiber composite boards and products, as described in U.S. Pat. No. 5,320,677, for example. Typically, such gypsum-containing cementitious products are made by preparing a mixture of calcined gypsum (calcium sulfate alpha or beta hemihydrate and/or calcium sulfate anhydrite), water, and other components, as appropriate to form gypsum slurry. The gypsum slurry and desired additives are often blended in a continuous mixer, as described in U.S. Pat. No. 3,359,146, for example.

In a typical gypsum board manufacturing process, gypsum board is produced by uniformly dispersing calcined gypsum (commonly referred to as "stucco") in water to form a dispersion of aqueous calcined gypsum. The aqueous calcined gypsum slurry is typically produced in a continuous manner by inserting stucco and water and other additives into a mixer which contains means for agitating the contents to form a uniform gypsum slurry. The slurry is continuously directed toward and through a discharge outlet of the mixer and into a discharge conduit connected to the discharge outlet of the mixer. Aqueous foam can be combined with the aqueous calcined gypsum slurry in the mixer and/or in the discharge conduit. A stream of foamed slurry passes through the discharge conduit from which it is continuously deposited onto a moving web of cover sheet material (i.e., the face sheet) supported by a forming table. The foamed slurry is allowed to spread over the advancing face sheet.

Various methods are known for producing foamed gypsum board having edges that are denser and harder than the core portion of the board, such as, by diverting a portion of the slurry from the mixing chamber. The diverted portion either contains a reduced amount of foam therein (and thus, is denser than slurry having a higher concentration of foam) or is then treated separately in one or more supplementary mixers with high agitation and/or defoaming agents to remove all or most of the foam and thus produce a harder, denser "edge" slurry to be cast at the edges of the cover sheet so that it comes into contact with the sides of the cast main slurry stream. Examples of such techniques are described in U.S. Pat. Nos. 2,985,219 and 4,279,673.

A second web of cover sheet material (i.e., the back sheet) is applied to cover the gypsum slurry and form a sandwich structure of a continuous wallboard preform. The wallboard preform is subjected to forming, such as at a conventional forming station, to obtain a desired thickness.

The calcined gypsum reacts with the water in the wallboard preform to form a matrix of crystalline hydrated gypsum or calcium sulfate dihydrate and sets as a conveyor moves the wallboard preform down the manufacturing line. The hydration of the calcined gypsum provides for the formation of an interlocking matrix of set gypsum, thereby imparting strength to the gypsum structure in the gypsum-containing product. The product slurry becomes firm as the crystal matrix forms and holds the desired shape.

After the wallboard preform is cut into segments downstream of the forming station at a point along the line where the preform has set sufficiently, the segments are flipped over, dried (e.g., in a kiln) to drive off excess water, and processed to provide the final wallboard product of desired dimensions. The aqueous foam produces air voids in the set gypsum, thereby reducing the density of the finished product relative to a product made using a similar slurry but without foam.

Prior devices and methods for addressing some of the operational problems associated with the production of gypsum wallboard are disclosed in commonly-assigned U.S. Pat. Nos. 5,643,510; 5,683,635; 6,494,609; 6,874,930; 7,007,914; and 7,296,919, which are incorporated by reference. The problem of lump formation in the mixer is a long-standing problem. When the calcined gypsum slurry exits the mixer containing lumps of gypsum and the slurry is fed to a board machine for introduction between paper cover sheets, the lumps of gypsum cause the paper sheets to break which requires stoppage of the board machine to remove the broken paper sheets and/or cleanup the gypsum slurry which may spill onto the board machine through the broken sheets.

U.S. Pat. No. 5,683,635 discloses the use of a device in the mixer commonly referred to as a "lump ring," which aids the mixing action in the mixer and is intended to prevent lumps of gypsum from being discharged from the mixer with the calcined gypsum slurry The lump ring comprises at least one ring projecting from a surface to define a small circumferential gap between the ring and an adjacent surface to prevent lumps larger in size than the gap from passing radially outward of the ring to the discharge outlet of the mixer. The lump ring can include two rings, projecting from opposing surfaces to define a labyrinthine path.

The size of the gap can affect the volumetric flow rate of material exiting the mixing chamber and correspondingly the amount of material held within the ring. The gap is fixed once the machine is operating, and it determines how much slurry can pass from the slurry mixer. The gap also determines the amount of slurry retained within the volume defined by the ring. It is thought that the more slurry resident within the mixer during its continuous operation the less chance there is for a lump to develop within the mixer. If the gap is too small, it can be difficult to obtain the necessary slurry volumetric flow rate to produce thicker products at a desired line speed, forcing the operator to reduce the line speed to obtain the desired product thickness. If the gap is too large, the volume within the ring is not kept sufficiently full with gypsum slurry to help prevent lumps.

Conventionally, to adjust the gap, the mixer is shut down and opened up. Shims are manually inserted between the lump breaker ring and rotor to adjust the gap. The mixer is then sealed up again and returned into service.

There is a continued need in the art to provide additional solutions to enhance the production of gypsum products. For example, there is a continued need for techniques for helping to reduce the tendency for lumps to develop within the mixer while being able to produce gypsum products with a range of desired thicknesses in a manner that is quick and simple without requiring excessive labor and/or downtime.

It will be appreciated that this background description has been created by the inventor to aid the reader and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims and not by the ability of any disclosed feature to solve any specific problem noted herein.

SUMMARY

In one aspect, the present disclosure is directed to embodiments of a mixing apparatus for producing aqueous calcined gypsum slurry. For example, in one embodiment, a mixing apparatus for producing aqueous calcined gypsum slurry includes a mixer housing, a rotor assembly, and an actuator system.

The mixer housing includes a top lid, a bottom, and a peripheral sidewall. The top lid and the bottom are in spaced relationship to each other along a normal axis. The peripheral sidewall extends along the normal axis between the bottom and the top lid. The mixer housing defines a mixing chamber within the mixer housing. The top lid includes a lid ring having an end face. The lid ring extends from the lid along the normal axis toward the bottom.

The rotor assembly includes a rotor and a drive shaft. The rotor is disposed within the mixing chamber of the mixer housing. The drive shaft extends along and is rotatable about the normal axis. The rotor is connected to the drive shaft such that the rotor extends radially from the drive shaft and is rotatively coupled therewith. The rotor has an upper surface which is in spaced relationship to the end face of the lid ring such that the lid ring and the upper surface of the rotor are separated by a lid ring gap along the normal axis.

The actuator system is arranged with the rotor assembly to selectively move the rotor over a range of travel along the normal axis between a lowered position and a raised position. The lid ring gap has a first value when the rotor is in the lowered position and a second value when the rotor is in the raised position, and the first value is greater than the second value.

In yet another aspect of the present disclosure, embodiments of a method of manufacturing a gypsum product are described. For example, in one embodiment, a method of manufacturing a gypsum product includes inserting calcined gypsum and water into a mixing chamber defined by a mixer housing of a mixing apparatus through at least one inlet defined within a top lid of the mixer housing. The top lid includes a lid ring. Each such inlet is disposed radially within the lid ring. A rotor disposed within the mixing chamber is rotated about a normal axis to form an aqueous dispersion of the calcined gypsum. An upper surface of the rotor is separated from the lid ring along the normal axis by a lid ring gap.

The aqueous dispersion of the calcined gypsum is discharged from the mixing chamber through a discharge outlet defined by the mixer housing into a discharge conduit. The discharge outlet is disposed radially outward of the lid ring. The rotor is moved along the normal axis relative to the lid ring such that the lid ring gap changes.

Further and alternative aspects and features of the disclosed principles will be appreciated from the following detailed description and the accompanying drawings. As will be appreciated, the systems and techniques for measuring the degree to which cementitious slurry has set during the manufacture of a cementitious article that are disclosed herein are capable of being carried out and used in other and different embodiments, and capable of being modified in various respects. Accordingly, it is to be understood that both the foregoing general description and the following detailed description are exemplary and explanatory only and do not restrict the scope of the appended claims.

Figure 1:
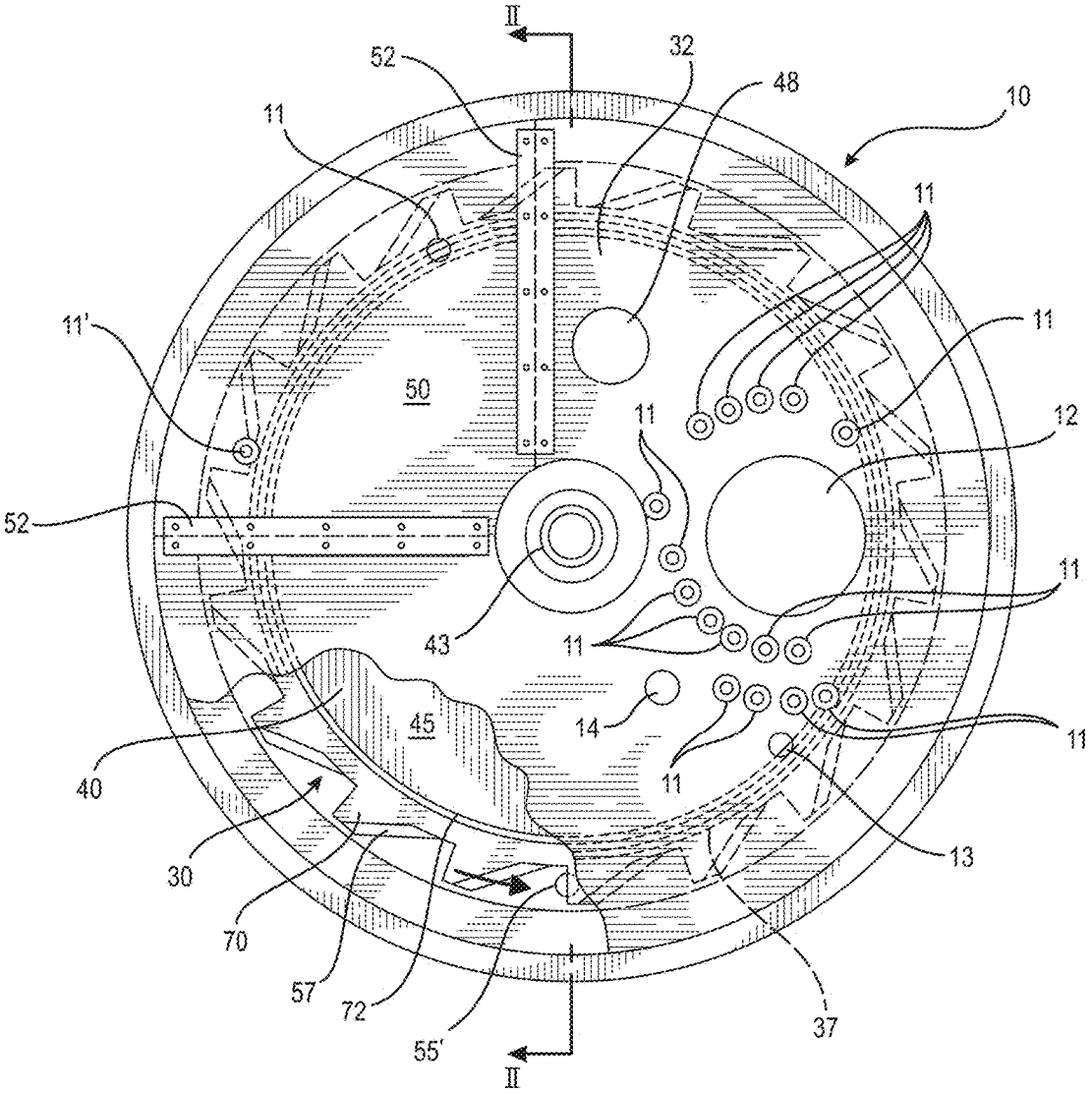
FIG. 1 is a schematic top plan view of an embodiment of a mixing apparatus for producing aqueous calcined gypsum slurry which is constructed in accordance with principles of the present disclosure.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood that this disclosure is not limited to the particular embodiments illustrated herein.

DETAILED DESCRIPTION OF EXEMPLARY EMBODIMENTS

The present disclosure provides various embodiments of a mixing apparatus for use in systems and methods for manufacturing various types of gypsum products, including gypsum wallboard, for example. In embodiments following principles of the present disclosure, a mixing apparatus can include an adjustable rotor which cooperates with a lid ring to define a correspondingly adjustable circumferential gap between the lid ring and the rotor.

Embodiments of a mixing apparatus following principles of the present disclosure can be used to carry out a method of manufacturing a gypsum product. Embodiments of a system for manufacturing a gypsum product following principles of the present disclosure can include an embodiment of a mixing apparatus which is constructed in accordance with principles of the present disclosure.

Embodiments of a mixing apparatus constructed according to principles of the present disclosure can comprise a type of mixer commonly referred to as a "continuous mixer," i.e., one in which the ingredients are continuously fed in measured quantities and in proportion according to a desired formulation. The various ingredients are continuously mixed and issue continuously from the mixer as a calcined gypsum slurry, such as, for introduction between cover sheets on a wallboard forming machine.

Embodiments of a mixing apparatus constructed according to principles of the present disclosure can be used to produce a variety of gypsum board having a range of thicknesses (e.g., one-quarter inch thick, three-eighths inch thick, one-half inch thick, five-eighths inch thick, three-quarters inch thick, etc.). Embodiments of a mixing apparatus constructed according to principles of the present disclosure can help produce boards of varying thicknesses with enhanced ease and adaptability by providing a means for adjusting a circumferential gap defined between a rotor within the mixing chamber and a lid ring depending from the lid of the housing. By varying the circumferential lid ring gap, a balance can be struck between keeping the lid ring gap as small as practical to help inhibit the formation of lumps within the mixing chamber and help prevent the discharge of lumps from the mixer onto the moving cover sheet and providing an adequate volumetric flow rate of aqueous calcined gypsum slurry from the mixer to produce the intended thickness of gypsum board at the desired line speed. As such, embodiments of a mixing apparatus constructed according to principles of the present disclosure can allow the amount of the mixing chamber filled with material during its continuous operation to be maintained at or above a desired percentage based on product mix and line speeds. Also, keeping the mixer substantially full during its operation is expected to prolong its useful life and/or increase the time between mixer maintenance events. A variety of product mixes (e.g., from ¼" through ¾") can be produced on a single board line while maintaining mixer volume to reduce/eliminate lumps. A mixing apparatus constructed according to principles of the present disclosure can be retrofitted into an existing system for manufacturing a gypsum product to help increase line speeds on various products where the prior mixer configuration and product mix limited the ability to increase the line speed.

Embodiments of a mixing apparatus following principles of the present disclosure can include a suitable actuator, such as a linear actuator operated by a servomotor, for example, to selectively drive the rotor up or down along its rotational axis to adjust the gap between the lump breaker ring depending from the lid and the rotor. In embodiments, a controller can be configured to apply travel limits to the servomotor to prevent the rotor from contacting the lump breaker ring. Positive feedback from the servo motor can be used to allow an operator to set a target set point based on the type of gypsum product being produced and the travel of the rotor can be timed similarly to other operation stations that are adjusted during a product changeover to maintain mixer volume through the changeover. In embodiments, an operator can adjust the circumferential lid ring gap on the fly with repeatability to maintain the slurry volume within the lid ring during the operation of the mixer over a range of product thicknesses and line speeds. The lid ring gap adjustability can help an operator maintain a desired line speed for a range of product mix while reducing/eliminating lump build up within the mixing chamber.

An apparatus for mixing calcined gypsum constructed according to principles of the present disclosure can help reduce the formation of lumps of gypsum within the mixing chamber by including a means for adjusting a circumferential gap defined between a lid lump breaker ring and the rotor. In embodiments of a method of manufacturing a gypsum product, an apparatus for continuously mixing calcined gypsum constructed according to principles of the present disclosure can be used to adjust a circumferential gap between a lid lump ring and a rotor by moving the rotor along its rotational axis relative to the lid lump ring.

Turning now to the Figures, an embodiment of a mixing apparatus 10 (or mixer 10) for producing aqueous calcined gypsum slurry which is constructed according to principles of the present disclosure is shown in FIG. 1. In the illustrated embodiment, the mixing apparatus 10 can be used at a wet end of a gypsum wallboard manufacturing line to mix water and calcined gypsum (also called stucco) together in a continuous manner to form an aqueous calcined gypsum slurry. In other embodiments, the mixing apparatus 10 can be used to make other types of gypsum products, as will be appreciated by one skilled in the art.

The mixer 10 is adapted to agitate water and a cementitious material (e.g., stucco) to form aqueous calcined gypsum slurry which is configured to form the core of the gypsum board. The mixer 10 can be placed in fluid communication with a discharge conduit configured to dispense the aqueous calcined gypsum slurry upon a moving cover sheet. Both the water and the stucco can be supplied to the mixer 10 via one or more inlets 11, 12 as is known in the art. In embodiments, any other suitable slurry additive can be supplied to the mixer 10 via a suitable inlet 13 as is known in the art of manufacturing cementitious products. Also, as is well known in the art, other materials or additives in addition to gypsum and water, often employed in slurries to prepare gypsum products (e.g. accelerators, retarders, fillers, starch, binders, strengtheners, etc.) can also be supplied through these or other inlet similarly positioned.

In embodiments, a foam injection system can be placed in fluid communication with at least one of the mixer 10 and the discharge conduit to introduce aqueous foam into the calcined gypsum slurry to lower its density. In embodiments, a foam inlet 14 is provided for insertion of at least some aqueous foam into the mixer 10 itself. The foam inlet 14 can also serve as an emergency water inlet.

Figure 2:
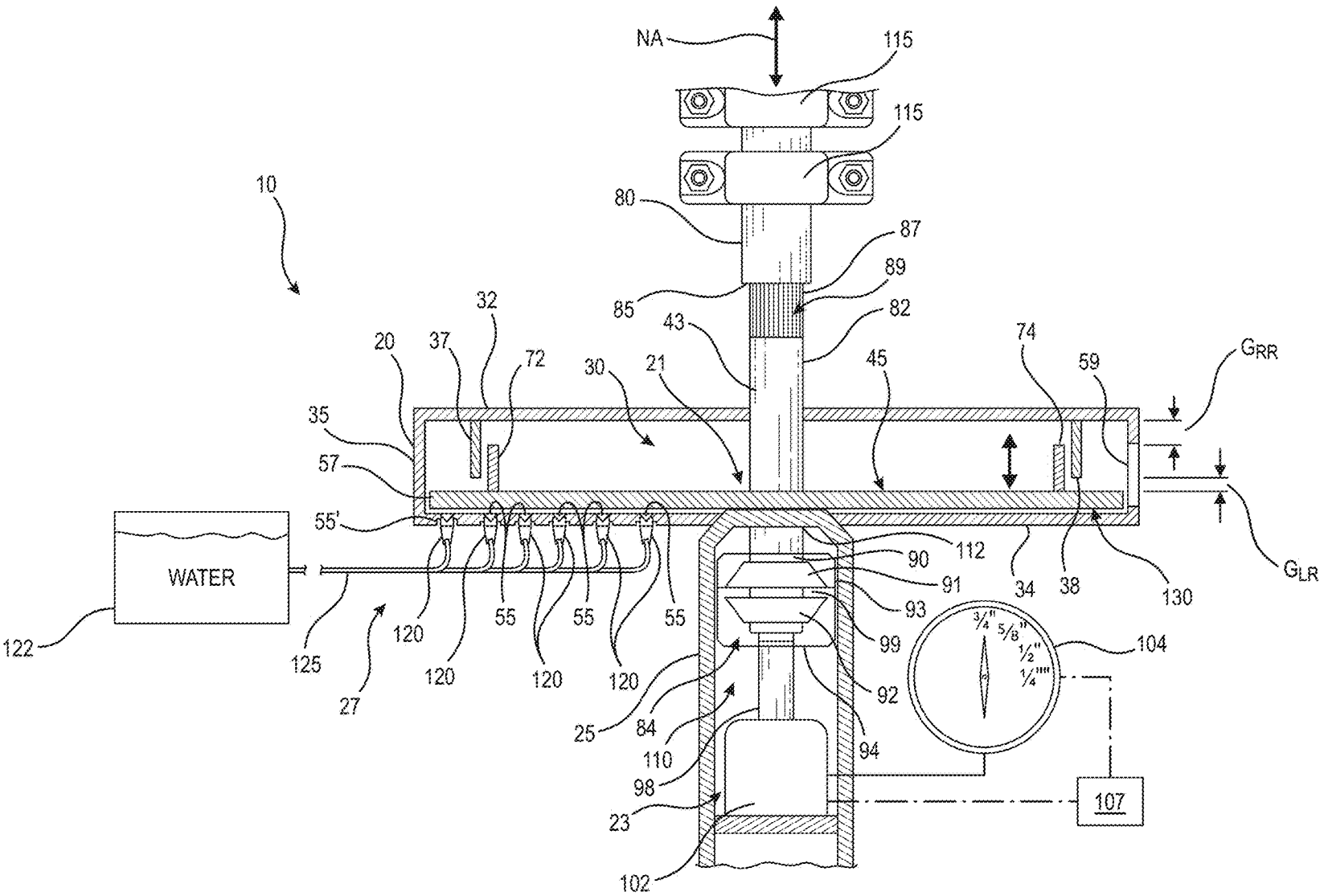
FIG. 2 is a cross-sectional view of the mixing apparatus of FIG. 1 taken along line II-II in FIG. 1.

Referring to FIG. 2, in the illustrated embodiment, the mixing apparatus 10 includes a mixer housing 20, a rotor assembly 21, an actuator system 23, an actuator housing 25, and a water spray system 27. The mixer housing 20 defines a mixing chamber 30 within the mixer housing 20 which is used to receive therein starting ingredients for the gypsum product. The rotor assembly 21 can be used to agitate the starting ingredients within the mixing chamber 30 to form an aqueous calcined gypsum slurry.

The mixer housing 20 includes a top lid 32, a bottom 34, and a peripheral sidewall 35. The top lid 32 and the bottom 34 are in spaced relationship to each other along a normal axis NA. The peripheral sidewall 35 extends along the normal axis NA between the bottom 34 and the top lid 32. The top lid 32 includes a lid ring 37 having an end face 38. The lid ring 37 extends from the lid 32 along the normal axis NA toward the bottom 34.

The rotor assembly 21 includes a rotor 40 and a drive shaft 43. The rotor is disposed within the mixing chamber 30 of the mixer housing 20. The drive shaft 43 extends along and is rotatable about the normal axis NA. The rotor 40 is connected to the drive shaft 43 such that the rotor 40 extends radially from the drive shaft 43 and is rotatively coupled therewith. The rotor 40 has an upper surface 45 which is in spaced relationship to the end face 38 of the lid ring 37 such that the lid ring 37 and the upper surface 45 of the rotor 40 are separated by a lid ring gap $G_{LR}$ along the normal axis NA.

Figure 4:
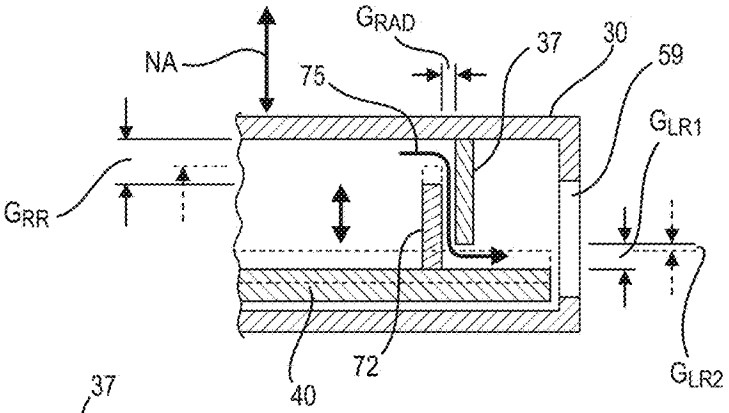
FIG. 4 is an enlarged detail view of the mixing apparatus of FIG. 1 taken from FIG. 3 as indicated by rectangle IV.
Figure 3:
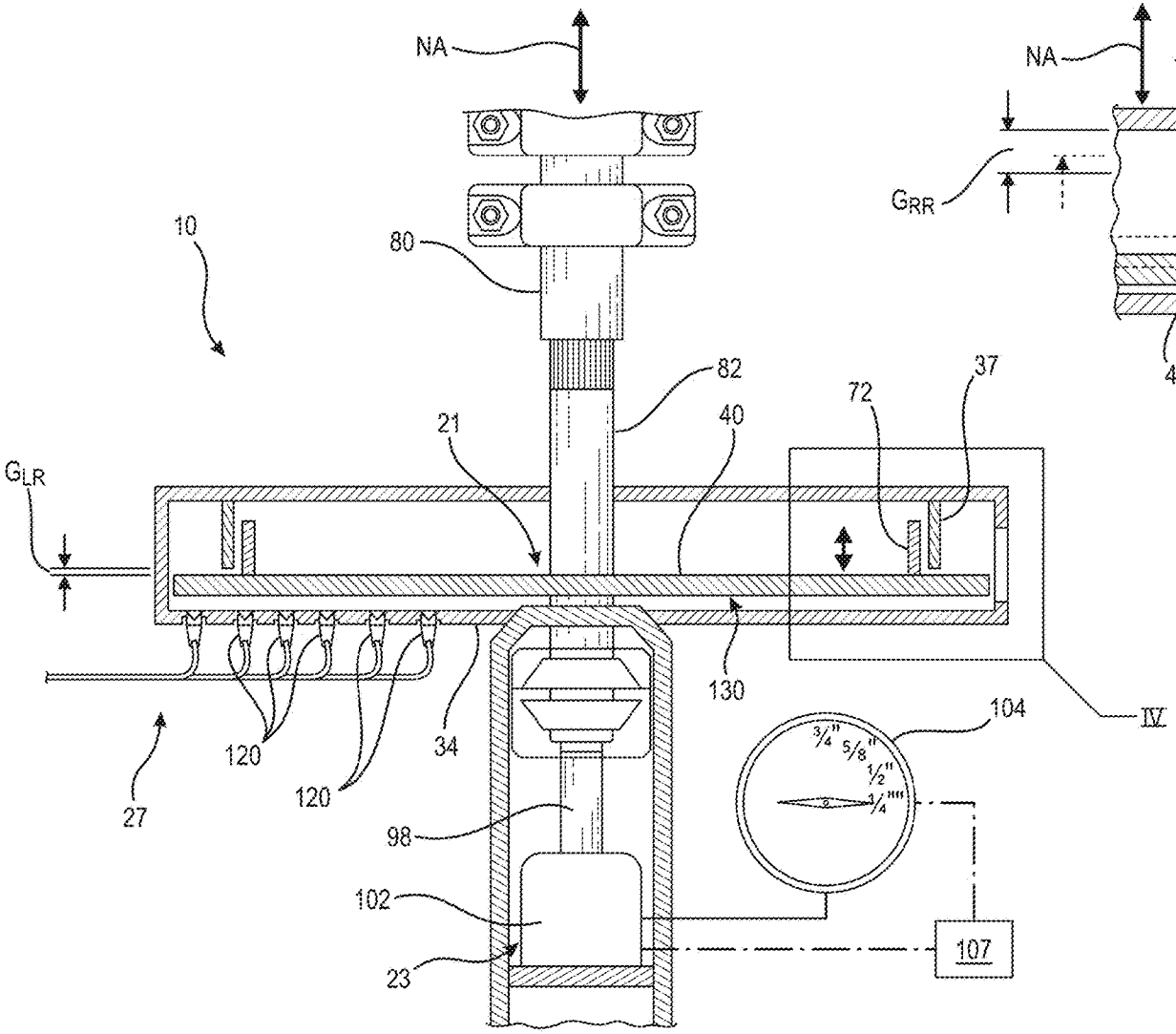
FIG. 3 is a view as in FIG. 2 of the mixing apparatus of FIG. 1, illustrating a rotor and its lump ring in an elevated position relative to its position shown in FIG. 2.

The actuator system 23 is arranged with the rotor assembly 21 to selectively move the rotor 40 over a range of travel along the normal axis NA between a lowered position (FIG. 2) and a raised position (FIG. 3). Referring to FIG. 4, the lid ring gap $G_{LR}$ between the lid ring 37 and the rotor 40 along the normal axis NA has a first value $G_{LR1}$ when the rotor 40 is in the lowered position and a second value $G_{LR2}$ when the rotor 40 is in the raised position. The first value $G_{LR1}$ is greater than the second value $G_{LR2}$.

Referring to FIG. 2, the actuator housing 25 is configured to house at least a portion of the actuator system 23. The actuator housing 25 can be configured to support the actuator system 23 and maintain its alignment with the drive shaft 43 of the rotor assembly 21 in such a way as to maintain their relative axial alignment with each other over the course of the rotor 40 reciprocally moving over its range of travel between the lowered position and the raised position.

The water spray system 27 is configured help keep the interior of the mixing chamber 30 clean and to help inhibit the formation of lumps within the mixing chamber 30. In embodiments, at least a portion of the water spray system 27 can be selectively operated, such as, when the rotor 40 is in the raised position, for example.

Referring to FIG. 1, in embodiments, the top lid 32 defines a water inlet 11 and a calcined gypsum inlet 12 therein. In embodiments, the water inlet 11 and the calcined gypsum inlet 12 are disposed radially within the lid ring 37. In the illustrated embodiment, the top lid 32 defines a plurality of water inlets 11 and a calcined gypsum inlet 12 which are disposed radially within the lid ring 37. In embodiments, the mixer housing 20 defines a plurality of water inlets 11 that are arranged near the calcined gypsum inlet 12. In embodiments, at least one water inlet 11' is disposed radially outside of the lid ring 37. In embodiments, the mixer housing 20 defines one or more other water inlets located closer to the radial periphery of the mixer housing 20. In embodiments, the calcined gypsum inlet 12 can be used to introduce other dry additives into the mixing chamber 30, as well. In embodiments, the top lid 32 defines at least one additive inlet 13 for receiving an additive therethrough. In embodiments, the top lid 32 defines a foam inlet 14 therein. The water inlets 11, 11', the calcined gypsum inlet 12, and any additive inlet(s) 13, 14 are in communication with the mixing chamber 30.

In embodiments, the top lid 32 defines a mixer vent opening 48 that is in communication with the mixing chamber 30. The mixer vent opening 48 can be associated with an exhaust pipe or other conduit that is configured to promote the adequate venting of the mixing chamber 30.

Referring to FIG. 1, the illustrated top lid 32 is generally circular. In the illustrated embodiment, the top lid 32 includes a removable segment 50 connected to the remainder of the top lid 32 via suitable connectors 52. The segment 50 can be provided to facilitate access to the mixing chamber 30 without removing the remainder of the top lid 32. In use, only the segment 50 is removed in order to perform certain inspection and/or maintenance operations.

The illustrated bottom 34 is also generally circular and corresponds with the top lid 32. Referring to FIG. 2, in embodiments, the bottom 34 of the mixer housing 20 defines at least one bottom water inlet 55. In the illustrated embodiment, the bottom 34 of the mixer housing 20 defines a plurality of bottom water inlets 55. In embodiments, at least one of the bottom water inlets 55 is positioned radially inward with respect to at least one other of the bottom water inlets 55. In the illustrated embodiment, the bottom water inlets 55 extend along a radial line between the rotor outer periphery 57 and the drive shaft 43, and the bottom water inlets 55 are in spaced radial relationship to each other.

In embodiments, at least one bottom water inlet 55 is positioned radially within the rotor outer periphery 57. In the illustrated embodiment, the bottom water inlets 55 are all positioned radially within the rotor outer periphery 57.

The peripheral sidewall 35 circumscribes the periphery of both the bottom 34 and the top lid 32. In embodiments, at least one of the peripheral sidewall 35 and the bottom define an outlet 59 therein. In embodiments, the outlet 59 is disposed radially outward of the lid ring 37. In the illustrated embodiment, the peripheral sidewall 35 defines the outlet 59. Although it is contemplated that the specific configuration of the mixer 10 can vary, it is preferred that the present mixer is of the centrifugal type commonly used in the manufacture of gypsum wallboard, and also of the type in which the outlet 59 dispenses the slurry tangentially to the mixer housing 20. In the illustrated embodiment, the outlet 59 is generally rectangular.

In embodiments, the outlet 59 of the housing 20 can be associated with any suitable discharge conduit, as will be appreciated by one skilled in the art. In embodiments, the outlet 59 is associated with an intermediate connection member of the discharge conduit referred to as a "gate," examples of which are shown and described in U.S. Patent Application Publication Nos. 2015/0328607; 2016/0121287; and 2017/0065950, for example. The gate is typically a rectangular discharge gate or slot with a cutoff block or door. A cutoff block can be installed in the discharge gate to mechanically adjust the flow of slurry for the desired thickness of wallboard, typically ranging from one-quarter inch to one inch, for example. The discharge gate can be configured to help control the flow of slurry out of the outlet 59 of the mixer 10 via adjustment of the cutoff block to increase or decrease the volumetric flow of aqueous calcined gypsum slurry from the mixing chamber 30.

Foam and/or other additives are typically added through a foam injection port on an outer side wall of the discharge gate through which aqueous foam or other desired additives, such as retarders, accelerators, dispersants, starch, binders, and strength-enhancing products including poly-phosphates, sodium trimetaphosphate, and the like, after the slurry has been substantially mixed. An inlet opening of the discharge gate for receiving the mixed slurry is typically equipped with lump bars or grating for preventing slurry lumps from entering into the discharge conduit.

In embodiments, the mixer includes a rotor 40 that acts as an impeller for agitating the contents to be mixed into a mixture or slurry. Referring to FIGS. 1 and 2, in the illustrated embodiment, the rotor assembly 21 includes the rotor 40 and the drive shaft 43. The rotor 40 is rotatably mounted within the mixing chamber 30. The rotor 40 comprises a radially-extending disc to which is attached the drive shaft 43 which defines the rotational axis of the rotor 40.

Referring to FIG. 1, in the illustrated embodiment, the rotor 40 includes a series of rotor teeth 70 disposed at the outer periphery 57 of the rotor 40. The rotor teeth 70 are configured to propel the aqueous gypsum slurry out of the mixing chamber 30 via the discharge outlet.

In embodiments, the mixer 10 includes a two-ring arrangement for the lump ring: the lid ring 37 and a rotor ring 72, as shown in FIGS. 1 and 2. Referring to FIG. 2, the rotor ring 72 extends from the upper surface 45 of the rotor 40 along the normal axis NA to a distal end face 74. The rotor ring 72 extends along the normal axis NA toward the top lid 32 such that the end face 74 of the rotor ring 72 is in spaced relationship with the top lid 32 along the normal axis NA by a rotor ring gap $G_{RR}$. In the illustrated embodiment, the rotor ring 72 is disposed radially inwardly of the lid ring 37. The rotor ring 72 can be referred to as a rotating ring, and the lid ring 37 as a stationary ring in that the rotor ring 72 rotates about the normal axis NA in response to the rotation of the rotor 40. The lid ring 37 remains stationary relative to the rotating rotor ring 72.

Referring to FIG. 4, in embodiments, the rotor ring gap $G_{RR}$ has a greater value when the rotor 40 is in the lowered position and a smaller value when the rotor 40 is in the raised position. In embodiments, the value of the rotor ring gap $G_{RR}$ is different from the value of the lid ring gap $G_{LR}$ when the rotor 40 is in the lowered position. In embodiments, the value of the rotor ring gap $G_{RR}$ is different from the value of the lid ring gap $G_{LR}$ when the rotor 40 is in the raised position.

In embodiments, a radial gap $G_{RAD}$ between the rotating rotor ring 72 and the stationary lid ring 37 can vary, such as from about one eighth inch to about one quarter inch, for example. The configuration of the rotor ring 72 and the lid ring 37 define a labyrinthine path 75 for the exiting aqueous calcined gypsum slurry to travel in order to exit the outlet 59 of the mixing chamber 30. This arrangement can help increase the residence time of the starting materials within the circumference of the lid ring 37 to enhance the uniform mixing of these ingredients.

It should be appreciated that this discussion of a rotor is meant to indicate the basic principles of rotor commonly employed in gypsum slurry mixing chambers known in the art. Alternative rotor designs, including those employing pins, paddles, plows, etc., are contemplated.

Referring to FIG. 2, the drive shaft 43 extends through the top lid 32 of the mixer housing 20. The drive shaft 43 can be connected to a conventional drive source, such as, a motor, for example, for rotating the drive shaft 43 about the normal axis NA at a suitable speed (e.g., 275-300 rpm) appropriate for rotating the rotor 40 to mix the contents of the mixing chamber 30 of the mixer 10. This rotation directs the resulting aqueous slurry in a generally centrifugal direction, such as in a counter-clockwise outward spiral, as shown in FIG. 1.

Referring to FIG. 2, in the illustrated embodiment, the drive shaft 43 comprises a telescoping drive shaft assembly to accommodate the translational movement of the rotor 40 along its rotational axis by the actuator system 23 to change the lid ring gap $G_{LR}$. In the illustrated embodiment, the telescoping drive shaft assembly includes a hollow sleeve 80, a rotor shaft 82, and a thrust bearing assembly 84.

The hollow sleeve 80 defines an end opening 85 in communication with an internal spline surface. The rotor shaft 82 includes a first end 87 having an external spline surface 89 and a second end 90 which is in opposing relationship to the first end 87 of the rotor shaft along the normal axis NA. The rotor shaft 82 extends through the end opening 85 of the hollow sleeve 80 such that the first end 87 of the rotor shaft 82 is disposed within the hollow sleeve 80. The external spline surface 89 of the rotor shaft 82 is in enmeshed engagement with the internal the spline surface of the hollow sleeve 80 to rotatively couple the rotor shaft 82 and the hollow sleeve 80. The rotor 40 is connected to the rotor shaft 82 at an intermediate point between the first end 87 and the second end 90 of the rotor shaft 82 along the normal axis NA such that the rotor shaft 82 extends through the rotor 40.

The rotor shaft 82 is movable along the normal axis NA relative to the hollow sleeve 80 in response to the actuator system 23 moving the rotor 40 over the range of travel between the lowered position (FIG. 2) and the raised position (FIG. 3). Using a splined engagement between the rotor shaft 82 and the hollow sleeve 80 permits the rotor 40 to be raised and lowered along the normal axis NA by the actuator system 23.

Referring to FIG. 2, the thrust bearing assembly 84 is disposed at the second end 90 of the rotor shaft 82. The thrust bearing assembly 84 is configured to permit the rotor shaft 82 to rotate about the normal axis NA relative to the actuator system 23 and to move the rotor shaft 82 along the normal axis NA relative to the sleeve 80 in response to operative movement of the actuator system 23.

In the illustrated embodiment, the thrust bearing assembly 84 includes a top thrust bearing 91, a bottom thrust bearing 92, a top bearing cap 93, and a bottom bearing cap 94. The top thrust bearing 91 and the top bearing cap 93 are associated with the second end 90 of the rotor shaft 82. The bottom thrust bearing 92 and the bottom bearing cap 94 are associated with a piston rod 98 of the actuator system 23. The thrust bearings 91, 92 are in confronting relationship with each other to permit relative rotation about the normal axis NA between the rotor shaft 82 and the piston rod 98 while transmitting an axial load along the normal axis NA therebetween. The top and bottom bearing caps 93, 94 are configured to housing the top and bottom thrust bearings 91, 92 therein and to maintain the thrust bearings 91, 92 together to define a bearing interface 99 therebetween.

The actuator system 23 is arranged with the rotor assembly 21 to selectively move the rotor 40 over a range of travel along the normal axis NA between the lowered position (FIG. 2) and the raised position (FIG. 3). In embodiments, the actuator system 23 can include any suitable equipment that is adapted to selectively translate the rotor 40 along its rotational axis NA between the lowered position and the raised position to change the lid ring gap $G_{LR}$.

In the illustrated embodiment, the actuator system 23 comprises a linear actuator having a motor 102 and a piston rod 98. The motor 102 is arranged with the piston rod 98 to selectively reciprocally move the piston rod 98 over a range of travel along the normal axis NA. In embodiments, the motor 102 can comprise any suitable motor, such as a servomotor, for example. The second end 90 of the rotor shaft 82 and the piston rod 98 of the linear actuator are connected together via the thrust bearing assembly 84.

In the illustrated embodiment, the linear actuator includes a piston rod position sensor 104 and a controller 107. The piston rod position sensor 104 is configured to detect the position of the piston rod 98 along the normal axis NA and to generate a position signal indicative of the position of the rotor 40 along the normal axis NA relative to the lid ring 37. In embodiments, the piston rod position sensor 104 can be any suitable device, such as an encoder, for example.

The controller 107 can be configured to control the motor 102 to selectively reciprocally move the rotor 40 over the range of travel between the lowered position (FIG. 2) and the raised position (FIG. 3). The controller 107 is in electrical communication with the piston rod position sensor 104 to receive the position signal therefrom. The controller 107 can be in operable relationship with the motor 102 of the linear actuator and be programmed to control the motor 102 to adjust the position of the piston rod 98 based upon the position signal. Using a servo application with position feedback, as in the illustrated embodiment, an operator can adjust the clearance between the lid lump breaker ring 37 and the rotor 40 on the fly without having to open the housing 20 of the mixer 10. In embodiments, the controller 107 can be configured to selectively move the rotor 40 over the range of travel between the lowered position (FIG. 2) and the raised position (FIG. 3) while the rotor 40 is rotating about the normal axis NA.

In embodiments, the controller 107 can be programmed to limit the movement of the piston rod 98 to set the maximum raised position of the rotor 40 so that the rotor 40 does not contact the lid ring 37. In embodiments, the upper limit of movement for the rotor 40 can be varied depending upon the particular lid ring structure installed within the mixer 10.

Referring to FIG. 2, in embodiments, the actuator housing 25 is configured to house the thrust bearing assembly 84 and the linear actuator 23 in such a way as to maintain their relative axial alignment with each other and with the rotor shaft 82 to which the linear actuator 23 is connected via the thrust bearing assembly 84. In the illustrated embodiment, the actuator housing 25 is in contacting relationship with the bottom 34 of the mixer housing 20. The actuator housing 25 defines an interior guide chamber 110 and an upper opening 112 in communication with the guide chamber 110. The rotor shaft 82 extends through the upper opening 112 of the actuator housing 25 such that the second end 90 of the rotor shaft 82 is disposed within the guide chamber 110. The thrust bearing assembly 84 and the linear actuator 23 are both disposed within the guide chamber 110. The guide chamber 110 is configured to maintain the thrust bearing assembly 84 and the linear actuator 23 in an axially aligned orientation with respect to each other. In embodiments, one or more roller bearings 115 can be associated with the hollow sleeve 80 to further maintain the axial alignment of the drive shaft 43 and the piston rod 98 of the actuator system 23 over the range of travel of the rotor 40.

In embodiments, the water spray system 27 includes a plurality of spray nozzles 120 in selective fluid communication with a source of water 122. The spray nozzles 120 can be configured to help keep the interior of the mixing chamber 30 clean and to help inhibit the formation of lumps within the mixing chamber 30.

In embodiments, any suitable spray nozzle can be used. For example, in embodiments, the spray nozzles 120 comprise stainless steel spray nozzles that emit water in a fan shape. In embodiments, the volumetric flow rate of the water fed through the spray nozzles 120 can be varied in order to achieve the desired cleaning effect. In embodiments, any suitable connection can be provide to place the spray nozzles 120 in fluid communication with the source of water 122, such as a suitable conduit 125 or manifold configuration.

In the illustrated embodiment, the water spray system 27 includes a number of spray nozzles 120 respectively positioned within the bottom water inlets 55 defined in the bottom 34 of the mixer housing 20. The source of water 122 is in selective fluid communication with the spray nozzles 120 to selectively direct a respective water spray against the rotor bottom surface 130. In embodiments, by providing one or more spray nozzles 120 in the bottom 34 of the mixer 10, the underside of the rotor 40 can be kept clean. The tendency for aqueous calcined gypsum slurry to cling to the bottom surface 130 of the rotor 40 (particularly when the rotor 40 is raised anywhere above the lowered position, such as is shown in FIG. 3) can be reduced by using the water spray system 27.

As previously discussed above, embodiments of the mixing apparatus 10 constructed according to principles of the present disclosure can be used to produce gypsum products in a continuous manner. An effective proportion of water can be mixed within the mixing chamber 30 with dry calcined gypsum (and other dry and wet additives as known to those skilled in the art) to produce an aqueous calcined gypsum slurry. In embodiments, the amount of water dispensed from the bottom spray nozzles 120 can be included as a portion of the metered amount of water fed to the mixer 10 according to the desired formulation for the gypsum product.

In embodiments, the bottom spray nozzles 120 can include at least one high-pressure spray nozzle that is configured to help clean the bottom surface 130 of the rotor 40 against which the water spray is directed. In embodiments, any suitable equipment (e.g., a pressure washer pump or other pressurizing device) can be used to pressurize the water being fed to the spray nozzle(s) 120 according to the intended pressure for the respective spray of water emitting therefrom. In embodiments, at least one high-pressure spray nozzle 120 (e.g., 400 psi or higher) is configured to direct a spray of water against the bottom surface 130 of the rotating rotor 40.

Referring to FIG. 1, in embodiments, a series of low-pressure water jets respectively positioned in a series of water inlets 11 defined in the top lid 32 are used to incorporate another portion of the metered amount of water into the calcined gypsum in the mixer 10. In embodiments, at least one of the water jets mounted in the top lid 32 comprises a high-pressure spray nozzle.

Figure 5:
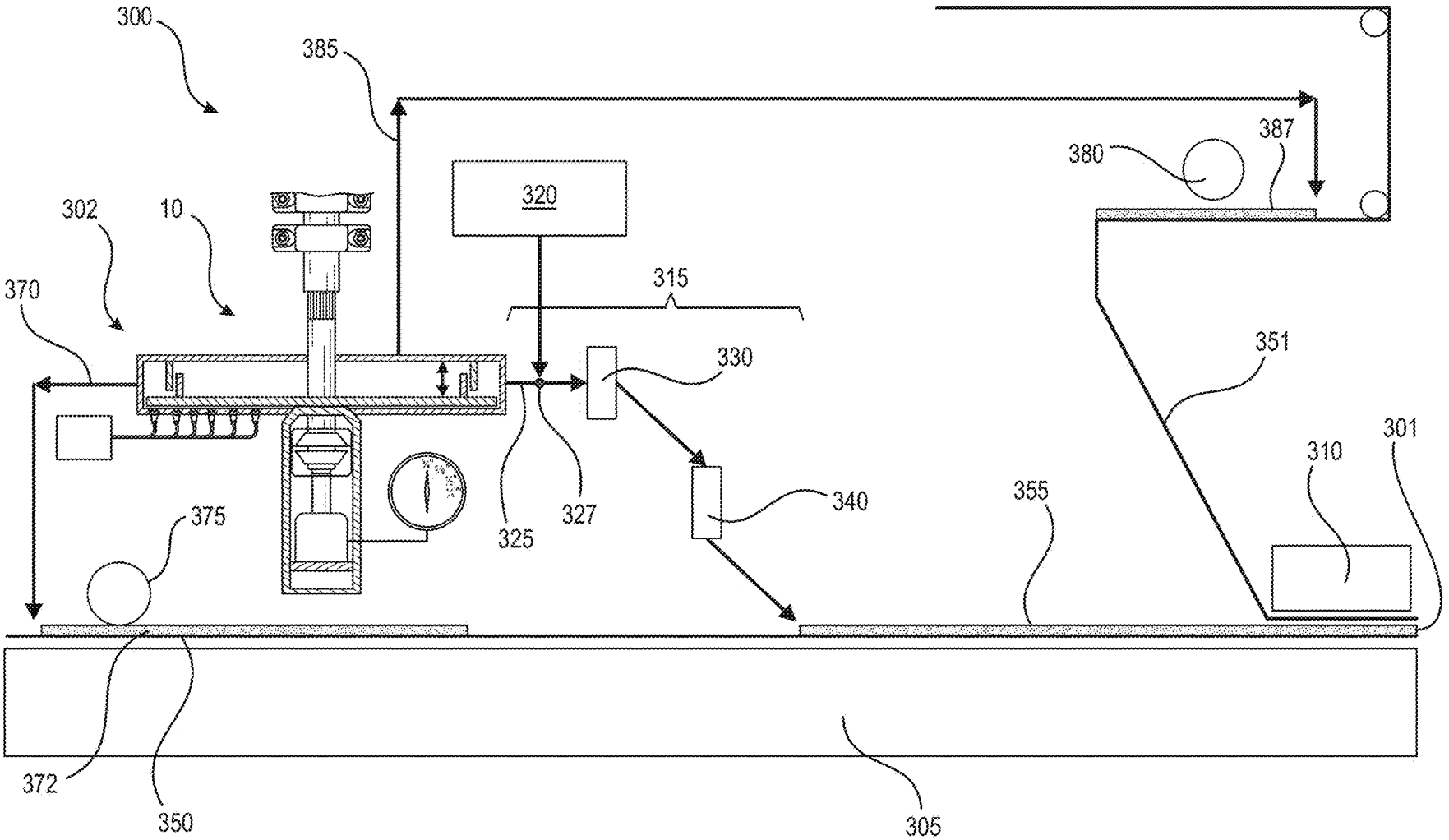
FIG. 5 is a fragmentary, schematic side elevational view of an embodiment of a system for manufacturing a gypsum product made from an aqueous calcined gypsum slurry in the form of a gypsum wallboard manufacturing line which is constructed in accordance with principles of the present disclosure.

Referring to FIG. 5, an exemplary embodiment of a wet end system 300 that includes a mixing apparatus 10 constructed according to principles of the present disclosure is shown. In embodiments, the wet end system 300 can include any suitable equipment adapted to mix and/or assemble the constituent materials forming a gypsum product 301. In embodiments, the wet end system 300 is configured as a gypsum wallboard wet end system.

In embodiments, the wet end system 300 includes a gypsum slurry mixing and dispensing system 302, a forming table 305, and a forming station 310. The gypsum slurry mixing and dispensing system 302 includes a mixing apparatus 10 constructed according to principles of the present disclosure in fluid communication with a slurry dispensing system 315. The mixer 310 is adapted to agitate water and calcined gypsum to form aqueous calcined gypsum slurry.

Both the water and the stucco can be supplied to the mixer 10 via one or more inlets as is known in the art. In embodiments, any other suitable slurry additive can be supplied to the mixer 10 as is known in the art of manufacturing gypsum products. In use, water and calcined gypsum can be agitated in the mixer to form aqueous calcined gypsum slurry. In some embodiments, water and calcined gypsum can be continuously added to the mixer in a water-to-calcined gypsum ratio from about 0.5 to about 1.3, and in other embodiments of about 0.9 or less.

In embodiments, the slurry dispensing system 315 can include a suitable discharge conduit, as is known in the art and examples of which are discussed in U.S. Pat. Nos. 6,494,609; 6,874,930; 7,007,914; and 7,296,919 and U.S. Patent Application Nos. 2012/0168527; 2012/0170403; 2013/0098268; 2013/0099027; 2013/0099418; 2013/0100759; 2013/0216717; 2013/0233880; and 2013/0308411, for example. The discharge conduit can be made from any suitable material and can have different shapes. In some embodiments, the discharge conduit can comprise a flexible conduit.

In embodiments, a foam injection system 320 can be arranged with at least one of the mixer 10 and the slurry dispensing system 315. The foam injection system 320 can include a foam source (e.g., such as a foam generation system configured as known in the art) and a foam supply conduit. In embodiments, any suitable foam source can be used. Preferably, the aqueous foam is produced in a continuous manner in which a stream of a mix of foaming agent and water is directed to a foam generator, and a stream of the resultant aqueous foam leaves the generator and is directed to and mixed with the cementitious slurry. In embodiments, any suitable foaming agent can be used. Preferably, the aqueous foam is produced in a continuous manner in which a stream of the mix of foaming agent and water is directed to a foam generator, and a stream of the resultant aqueous foam leaves the generator and is directed to and mixed with the slurry. Some examples of suitable foaming agents are described in U.S. Pat. Nos. 5,683,635 and 5,643,510, for example.

The slurry discharge conduit 315 is in fluid communication with the mixer 110. In embodiments, the slurry discharge conduit 315 can comprise any suitable discharge conduit component as will be appreciated by one skilled in the art. The illustrated discharge conduit 315 includes a delivery conduit 325, a foam injection body 327 of the foam injection system 320, a flow-modifying element 330, and a slurry distributor 340.

A first roll of cover sheet material is configured to be selectively dispensed such that the first cover sheet 350 is dispensed from the first roll upstream of the slurry dispensing system 315 and conveyed upon the forming table 305 extending between the slurry mixer and dispensing system 302 and the forming station 310. A second roll of cover sheet material is configured to be selectively dispensed such that a second cover sheet 351 is dispensed from the second roll upon the forming table 305 at a position between the slurry dispensing system 315 of the calcined gypsum slurry mixing and dispensing system 302 and the forming station 310 over the first cover sheet 350 and the slurry 355 dispensed from the slurry dispensing system 315. Gypsum board products are typically formed "front face down" such that the first cover sheet 350 dispensed from the first roll traveling over the forming table 305 serves as the "front face" cover sheet 350 of the finished gypsum board 301 (which will be positioned toward an interior of a room when the gypsum boards 301 are installed).

In embodiments, one or both of the cover sheets 350, 351 can be pre-treated with a thin, relatively denser layer of gypsum slurry (relative to the gypsum slurry comprising the core), often referred to as a "skim coat" in the art, and/or hard edges, if desired. To that end, in embodiments, the mixer 10 can include a first auxiliary conduit 370 that is adapted to deposit a stream of dense aqueous calcined gypsum slurry 372 that is relatively denser than the main flow of aqueous calcined gypsum slurry 355 delivered to the discharge conduit 315 (i.e., a "face skim coat/hard edge stream").

In embodiments, a hard edge/face skim coat roller 375 is disposed upstream of the slurry dispensing system of the calcined gypsum slurry mixing and dispensing system 302 and supported over the forming table 305 such that the first cover sheet 350 being dispensed from the first roll is disposed therebetween. The first auxiliary conduit 370 can deposit the face skim coat/hard edge stream 372 upon the first cover sheet 350 being dispensed from the first roll upstream of the skim coat roller which is adapted to apply a skim coat layer to the moving first cover sheet 350 and to define hard edges at the periphery of the moving first cover sheet 350 by virtue of the width of the roller 375 being less than the width of the moving first cover sheet 350 as is known in the art. Hard edges can be formed from the same dense slurry that forms the thin dense layer by directing portions of the dense slurry around the ends of the roller 375 used to apply the dense layer to the first cover sheet 350. In other embodiments, hard edges can be formed using other suitable techniques, as will be appreciated by one skilled in the art.

In some embodiments, a back skim coat roller 380 is disposed over a support element such that the second cover sheet 29 being dispensed from the second roll is disposed therebetween. The mixer 10 can also include a second auxiliary conduit 385 adapted to deposit a stream of dense aqueous calcined gypsum slurry 387 that is relatively denser than the main flow of aqueous calcined gypsum slurry 355 delivered to the discharge conduit 315 (i.e., a "back skim coat stream"). The second auxiliary conduit 385 can deposit the back skim coat stream 387 upon the moving second cover sheet 351 upstream (in the direction of movement of the second cover sheet 351) of the back skim coat roller 380 that is adapted to apply a skim coat layer to the second cover sheet 351 being dispensed from the second roll as is known in the art.

In other embodiments, separate auxiliary conduits can be connected to the mixer to deliver one or more separate edge streams to the moving cover sheet. Other suitable equipment (such as auxiliary mixers) can be provided in the auxiliary conduits to help make the slurry therein denser, such as by mechanically breaking up foam in the slurry and/or by chemically breaking up the foam through use of a suitable de-foaming agent inserted into the auxiliary conduit(s) through a suitable inlet.

The skim coat rollers 375, 380, the forming table 305, and the other support elements can all comprise equipment suitable for their respective intended purposes as is known in the art. The wet end system 300 can be equipped with other suitable equipment as is known in the art.

The wet end system 300, including the calcined gypsum slurry mixing and dispensing system 302, the forming table 305, and the forming station 310, is configured to mix and assemble constituent materials together such that a continuous gypsum board 301 having a predetermined nominal thickness is fed from the forming station. The forming station 310 can be configured to form the gypsum board 301 such that the gypsum board 301 is within a predetermined thickness range to produce gypsum board of a given nominal thickness (e.g., ¼-in., ⅜-in., ⅝-in., ¾-in. for example). The forming station 310 can comprise any equipment suitable for its intended purpose as is known in the art. For example, in embodiments, the forming station 310 can include a pair of forming plates or rolls in spaced relationship to each other along the normal axis NA. The gypsum board 301 passes through the vertically spaced-apart forming plates/rolls to determine the thickness of the gypsum board 301. Equipment can be provided that helps wrap the front face cover sheet 350 around the sides of the sandwich to enclose the edges of the gypsum board 301, including applying an adhesive to secure the front face cover sheet 350 to the back cover sheet 351.

In embodiments, other gypsum board manufacturing stations, such as, a cutting station; a transfer system, including a board inverter; a dryer (or kiln); and a booking and stacking system, for example. The cutting station can be situated a sufficient distance away from the forming station to allow the gypsum slurry constituting the gypsum core to adequately set before reaching the cutting station such that the gypsum board 301 can be cut cleanly. The cutting station can include a knife configured to periodically cut the gypsum board 301 along a transverse axis to define a series of board segments as the gypsum board 301 moves past the cutting station. In embodiments, the knife can be a rotary knife as is generally known to those skilled in the art. The transfer system can be configured to flip the gypsum boards 301 over such that the boards are sent through the kiln (drier) in a front face up position.

The kiln can be configured to provide an environment with an elevated temperature sufficient to drive off free water in the gypsum board that is not otherwise used in the chemical hydration reaction occurring in the aqueous gypsum slurry forming the core of the gypsum board 301. In embodiments, the kiln (drier) can comprise any suitable equipment as known to those skilled in the art.

In embodiments, a suitable booking unit can be interposed between the kiln and a stacking system. The booking unit can be configured to place a pair of boards together in a "booked" relationship in which the front faces of the pair of booked gypsum boards are mated together with the pair of boards being in a stacked relationship. In embodiments, the booking unit can comprise any suitable equipment as known to those skilled in the art. One skilled in the art will understand that other equipment and/or manufacturing stations can be included in embodiments of a gypsum board manufacturing line suitable for producing gypsum board which can be evaluated according to principles of the present disclosure. The stacking unit can be configured to receive a series of pairs of booked board one on top of the other. The series of booked boards can be palletized or otherwise bundled for shipping.

Figure 6:
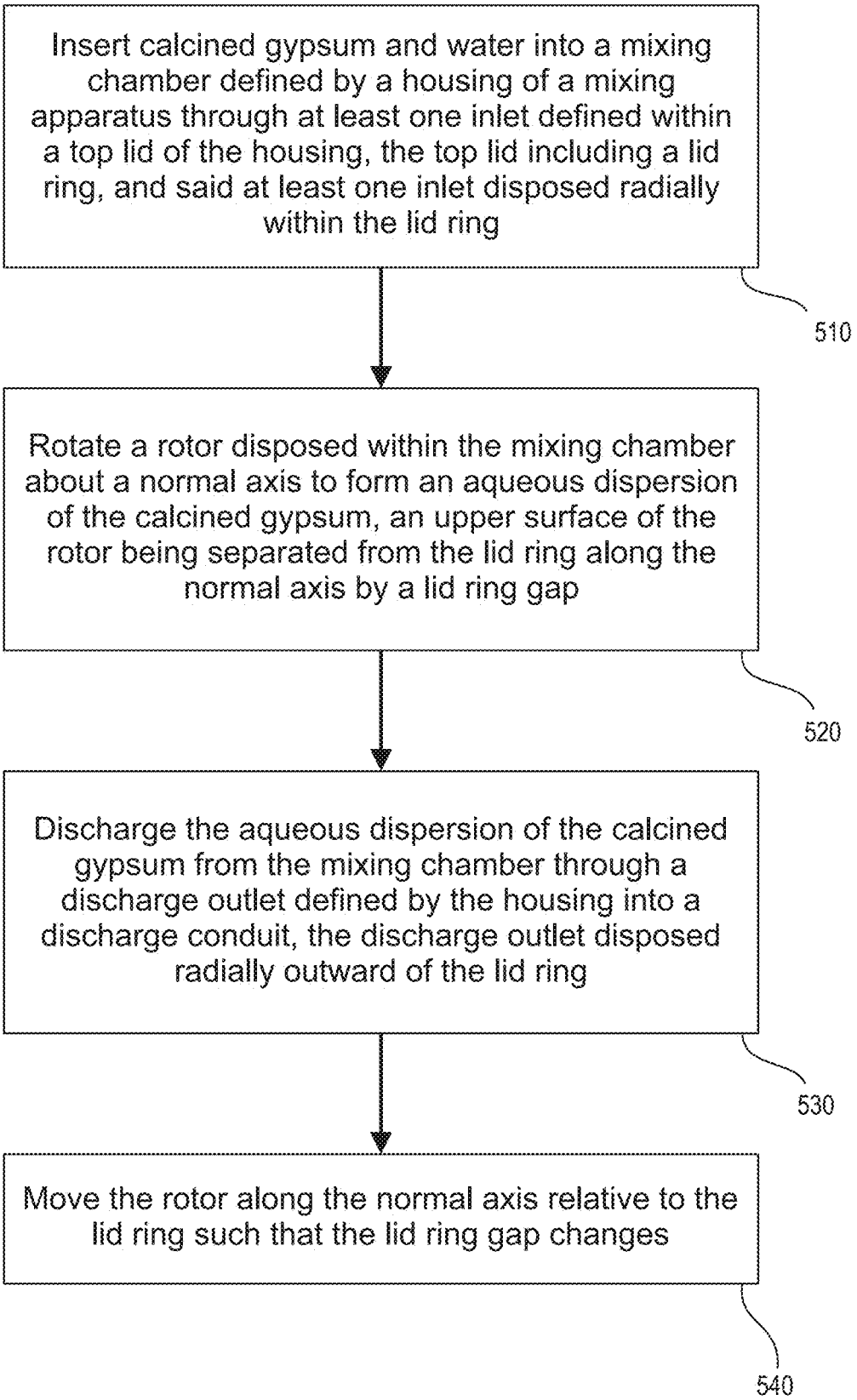
FIG. 6 is a flowchart illustrating steps of an embodiment of a method of manufacturing a gypsum product following principles of the present disclosure.

Referring to FIG. 6, steps of an embodiment of a method 500 of manufacturing a gypsum product following principles of the present disclosure are shown. In embodiments, a method of manufacturing a gypsum product following principles of the present disclosure can be used with any embodiment of a mixing apparatus constructed according to principles discussed herein.

The illustrated method 500 of manufacturing a gypsum product includes inserting calcined gypsum and water into a mixing chamber defined by a mixer housing of a mixing apparatus through at least one inlet defined within a top lid of the mixer housing (step 510). In embodiments, at least one inlet defined by the top lid is disposed radially within the lid ring. In embodiments, at least one water inlet, at least one calcined gypsum inlet, and at least one additive inlet are disposed radially within the lid ring. In embodiments, at least one inlet can be used to provide both water and at least one additive to the mixing chamber of the housing. The top lid includes a lid ring.

A rotor, which is disposed within the mixing chamber, is rotated about a normal axis to form an aqueous dispersion of the calcined gypsum (step 520). An upper surface of the rotor is separated from the lid ring along the normal axis by a lid ring gap.

The aqueous dispersion of the calcined gypsum is discharged from the mixing chamber through a discharge outlet defined by the mixer housing into a discharge conduit (step 530). The discharge outlet is disposed radially outward of the lid ring.

The rotor is moved along the normal axis relative to the lid ring such that the lid ring gap changes (step 540). In embodiments, the rotor is reciprocally movable over a range of travel between a lowered position and a raised position. For example, in embodiments, moving the rotor comprises moving the rotor from a lowered position to a raised position. The upper surface of the rotor is farther from the lid ring along the normal axis when the rotor is in the lowered position than when in the raised position, and a rotor bottom is closer to a bottom of the mixer when the rotor is in the lowered position than when in the raised position.

In embodiments of a method of manufacturing a gypsum product following principles of the present disclosure, the method 500 can include directing a spray of water against the rotor bottom when the rotor is in the raised position. In embodiments, water can be sprayed against the underside of the rotor along a radial line from an outer periphery of the rotor to its center (where it is attached to the rotor shaft). In embodiments, water can be sprayed along all or part of the radial line.

In embodiments, moving the rotor to change the lid ring gap is based upon a volume of the aqueous dispersion of the calcined gypsum being discharged from the mixing chamber. For example, when the thickness of the gypsum board being produced increases, a greater volumetric flow rate of aqueous calcined gypsum slurry is used to produce gypsum board at a given line speed than when the gypsum board has a smaller thickness (for the same line speed). In embodiments, the lid ring gap can be increased when the gypsum board thickness increases. In embodiments, the lid ring gap can be decreased in response to the thickness of the gypsum board being produced decreases. In embodiments, the size of the lid ring gap is correlated to the thickness of the gypsum board being produced (for a given line speed).

In embodiments, moving the rotor occurs as the aqueous dispersion of the calcined gypsum is discharging from the mixing chamber. For example, should it be desired to increase the line speed of the board machine producing gypsum board of a given thickness, the lid ring gap can be increased to allow a greater volumetric flow rate of gypsum slurry to be discharged from the mixing apparatus. In embodiments, the rotor can be moved along the normal axis relative to the lid ring to change the lid ring gap without shutting down the line or ceasing operation of the mixer.

All references cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A mixing apparatus for producing aqueous calcined gypsum slurry, the mixing apparatus comprising:

a mixer housing, the mixer housing including a top lid, a bottom, and a peripheral sidewall, the top lid and the bottom in spaced relationship to each other along a normal axis, the peripheral sidewall extending along the normal axis between the bottom and the top lid, the mixer housing defining a mixing chamber therewithin, the top lid including a lid ring, the lid ring having an end face, the lid ring extending from the lid along the normal axis toward the bottom, the top lid defining an inlet, the inlet disposed radially within the lid ring;

a rotor assembly, the rotor assembly including a rotor and a drive shaft, the rotor disposed within the mixing chamber of the mixer housing, the drive shaft extending along and rotatable about the normal axis, the rotor being connected to the drive shaft such that the rotor extends radially from the drive shaft and is rotatively coupled therewith, the rotor having an upper surface, the upper surface of the rotor being in spaced relationship to the end face of the lid ring such that the lid ring and the upper surface of the rotor are separated by a lid ring gap along the normal axis, the rotor having a rotor outer periphery, the lid ring being disposed radially within the rotor outer periphery;

an actuator system, the actuator system arranged with the rotor assembly to selectively move the rotor over a range of travel along the normal axis between a lowered position and a raised position, wherein the lid ring gap has a first value when the rotor is in the lowered position and a second value when the rotor is in the raised position, the first value being greater than the second value.

2. The mixing apparatus according to claim 1, wherein the rotor includes a rotor bottom, and the bottom of the mixer housing defines a bottom water inlet, the bottom water inlet positioned radially within the rotor outer periphery, and the mixing apparatus further comprising:

a spray nozzle, the spray nozzle positioned within the bottom water inlet;

a source of water, the source of water being in selective fluid communication with the spray nozzle to selectively direct a water spray against the rotor bottom.

3. The mixing apparatus according to claim 1, wherein the rotor includes a rotor bottom, and the bottom of the mixer housing defines a plurality of bottom water inlets, the bottom water inlets positioned radially within the rotor outer periphery, the mixing apparatus further comprising:

a plurality of spray nozzles, the spray nozzles respectively positioned within the bottom water inlets;

a source of water, the source of water being in selective fluid communication with the spray nozzles to selectively direct a respective water spray against the rotor bottom.

4. The mixing apparatus according to claim 3, wherein at least one of the plurality of bottom water inlets is positioned radially inward with respect to at least one other of the bottom water inlets.

5. The mixing apparatus according to claim 4, wherein the bottom water inlets extend along a radial line between the rotor outer periphery and the drive shaft, and the bottom water inlets are in spaced radial relationship to each other.

6. The mixing apparatus according to claim 1, wherein the drive shaft comprises a telescoping drive shaft assembly, the telescoping drive shaft assembly including a hollow sleeve with an internal spline surface and a rotor shaft with an external spline surface disposed at a first end thereof, the hollow sleeve defining an end opening, the first end of the rotor shaft disposed within the hollow sleeve such that the spline surfaces are in enmeshed engagement with each other to rotatively couple the shaft and the hollow sleeve, the rotor shaft being movable along the normal axis relative to the hollow sleeve in response to the actuator moving the rotor over the range of travel between the lowered position and the raised position.

7. The mixing apparatus according to claim 6, wherein the rotor shaft includes a second end, the second end being in opposing relationship to the first end of the rotor shaft along the normal axis, the rotor being connected to the rotor shaft at an intermediate point between the first end and the second end of the rotor shaft along the normal axis such that the rotor shaft extends through the rotor.

8. The mixing apparatus according to claim 7, wherein the actuator system comprises a linear actuator having a motor and a piston rod, the motor arranged with the piston rod to selectively reciprocally move the piston rod over a range of travel along the normal axis, and wherein the telescoping drive shaft assembly includes a thrust bearing assembly, the second end of the rotor shaft and the piston rod of the linear actuator connected together via the thrust bearing assembly, the thrust bearing assembly configured to permit the rotor shaft to rotate about the normal axis relative to the actuator system and to move the rotor shaft along the normal axis relative to the sleeve in response to movement of the piston rod.

9. The mixing apparatus according to claim 8, further comprising:

an actuator housing, the actuator housing in contacting relationship with the bottom of the mixer housing, the actuator housing defining an interior guide chamber and an upper opening in communication with the guide chamber, the rotor shaft extending through the opening of the actuator housing such that the second end of the rotor shaft is disposed within the guide chamber, and the thrust bearing assembly and the linear actuator being disposed within the guide chamber.

10. The mixing apparatus according to claim 8, wherein the linear actuator includes a piston rod position sensor and a controller, the piston rod position sensor configured to detect the position of the piston rod along the normal axis and to generate a position signal indicative of the position of the rotor along the normal axis relative to the lid ring, the controller being in electrical communication with the piston rod position sensor to receive the position signal therefrom, and the controller being in operable relationship with the motor of the linear actuator and being programmed to control the motor to adjust the position of the piston rod based upon the position signal.

11. The mixing apparatus according to claim 1, wherein the rotor includes a rotor ring, the rotor ring being in radial spaced relationship with the shaft, the rotor ring having an end face, the rotor ring extending from the upper surface of the rotor along the normal axis toward the top lid such that the end face of the rotor ring is in spaced relationship with the top lid along the normal axis by a rotor ring gap, and wherein the rotor ring gap has a third value when the rotor is in the lowered position and a fourth value when the rotor is in the raised position, the third value being greater than the fourth value.

12. The mixing apparatus according to claim 11, wherein the rotor ring is disposed radially inwardly of the lid ring.

13. The mixing apparatus according to claim 11, wherein the first value is different from the third value, and the second value is different from the fourth value.

14. The mixing apparatus according to claim 1, wherein the top lid defines a water inlet and a calcined gypsum inlet therein, the water inlet and the calcined gypsum inlet disposed radially within the lid ring.

15. The mixing apparatus according to claim 14, wherein at least one of the peripheral sidewall and the bottom define an outlet therein, the outlet disposed radially outward of the lid ring.

16. A method of manufacturing a gypsum product using a mixing apparatus for producing aqueous calcined gypsum slurry, the method comprising:

inserting calcined gypsum and water into a mixing chamber defined by a housing of a mixing apparatus through at least one inlet defined within a top lid of the housing, the top lid including a lid ring, and said at least one inlet disposed radially within the lid ring, the mixer housing including a bottom and a peripheral sidewall, the top lid and the bottom in spaced relationship to each other along a normal axis, the peripheral sidewall extending along the normal axis between the bottom and the top lid, the mixer housing defining the mixing chamber therewithin, the lid ring having an end face, the lid ring extending from the lid along the normal axis toward the bottom;

rotating a rotor of a rotor assembly disposed within the mixing chamber about a normal axis to form an aqueous dispersion of the calcined gypsum, an upper surface of the rotor being separated from the lid ring along the normal axis by a lid ring gap, the rotor assembly including the rotor and a drive shaft, the drive shaft extending along and rotatable about the normal axis, the rotor being connected to the drive shaft such that the rotor extends radially from the drive shaft and is rotatively coupled therewith, the rotor having an upper surface, the upper surface of the rotor being in spaced relationship to the end face of the lid ring such that the lid ring and the upper surface of the rotor are separated by a lid ring gap along the normal axis, the rotor having a rotor outer periphery, the lid ring being positioned radially within the rotor outer periphery;

discharging the aqueous dispersion of the calcined gypsum from the mixing chamber through a discharge outlet defined by the housing into a discharge conduit, the discharge outlet disposed radially outward of the lid ring;

moving, using an actuator system, the rotor along the normal axis relative to the lid ring such that the lid ring gap changes, the actuator system arranged with the rotor assembly to selectively move the rotor over a range of travel along the normal axis between a lowered position and a raised position, wherein the lid ring gap has a first value when the rotor is in the lowered position and a second value when the rotor is in the raised position, the first value being greater than the second value.

17. The method of manufacturing according to claim 16, wherein moving the rotor to change the lid ring gap is based upon a volume of the aqueous dispersion of the calcined gypsum being discharged from the mixing chamber.

18. The method of manufacturing according to claim 16, wherein moving the rotor occurs as the aqueous dispersion of the calcined gypsum is discharging from the mixing chamber.

19. The method of manufacturing according to claim 18, wherein moving the rotor comprises moving the rotor from the lowered position to the raised position, the upper surface of the rotor being farther from the lid ring along the normal axis when the rotor is in the lowered position than when in the raised position, and a rotor bottom being closer to a bottom of the mixer when the rotor is in the lowered position than when in the raised position.

20. The method of manufacturing according to claim 19, further comprising:

directing a spray of water against the rotor bottom when the rotor is in the raised position.

* * * * *